US008051786B2

(12) United States Patent
Ma

(10) Patent No.: US 8,051,786 B2
(45) Date of Patent: Nov. 8, 2011

(54) STOKER GRATES FOR CIRCULATING COMBUSTIBLE MATERIAL

(76) Inventor: Chengguo Ma, Shuangyashan (CN)

( * ) Notice: Subject to any disclaimer, the term of this patent is extended or adjusted under 35 U.S.C. 154(b) by 0 days.

(21) Appl. No.: 12/012,965

(22) Filed: Feb. 6, 2008

(65) Prior Publication Data

US 2008/0156238 A1 Jul. 3, 2008

Related U.S. Application Data

(63) Continuation of application No. 11/097,115, filed on Apr. 1, 2005, now abandoned.

(51) Int. Cl.
*F23K 3/10* (2006.01)
*F23H 7/14* (2006.01)

(52) U.S. Cl. ..... 110/281; 110/287; 110/291; 126/174

(58) Field of Classification Search ..... 110/291, 110/278, 268, 281, 275, 259, 269; 126/181, 126/182, 174, 169, 161, 170, 152 R, 152 B, 126/176 R, 177, 175, 179
See application file for complete search history.

(56) References Cited

U.S. PATENT DOCUMENTS

| | | | | |
|---|---|---|---|---|
| 2,035,128 | A * | 3/1936 | Hitchcock | 110/291 |
| 2,183,386 | A * | 12/1939 | Yeager | 110/275 |
| 2,777,406 | A * | 1/1957 | Turner et al. | 110/257 |
| 5,269,287 | A * | 12/1993 | Krieger | 110/281 |
| 5,549,471 | A * | 8/1996 | Tegtmeier et al. | 110/281 |

* cited by examiner

*Primary Examiner* — Kenneth Rinehart
*Assistant Examiner* — David J Laux
(74) *Attorney, Agent, or Firm* — MacMillan, Sobanski & Todd, LLC

(57) ABSTRACT

A stoker grate for circulating a combustible material includes a stationary grate sheet support and a moveable grate sheet support fitting with prop rolls on the stationary grate sheet support. The moveable grate sheet support includes a pair of moveable grate sheet supports opposed to each other and another pair of arc-shaped moveable grate sheet supports opposed to each other to form a long annular-shaped assembled support, stationary grate sheets fitting with mounting transverse beams of the stationary grate sheet support, moveable grate sheets fitting with mounting transverse beams of the moveable grate sheet support, the moveable grate sheets and the stationary grate sheets being disposed alternatingly, and a transmission unit. The driving moveable grate sheet support is hinged to the adjacent driven moveable grate sheet support and the driven moveable grate sheet supports are hinged to each other.

15 Claims, 4 Drawing Sheets

A– A

STOKER GRATES FOR CIRCULATING COMBUSTIBLE MATERIAL

CROSS-REFERENCE TO RELATED APPLICATIONS

This application is a continuation patent application of U.S. patent application Ser. No. 11/097,115 filed Apr. 1, 2005, now abandoned the disclosure of which is incorporated herein by reference.

BACKGROUND OF THE INVENTION

The invention relates to a boiler stoker, especially to the grate of horizontal circulating burning-up combustible material.

At present, the grates for stoker-fired boiler can be classified in structure into two kinds, i.e. the reciprocating grate and the chain grate. The fuel is fed continuously from one end of the grate surface and travels horizontally across the grate to the opposite end as it burns. The residual ash is discharged from the opposite end. The above mentioned stoker grates have the following defects: 1) the coal is ignited mainly by means of the heat radiation from the furnace arch, the ignition begins from the upper layer towards the lower layer of the coal bed in a direction which is opposite to the direction of air flow, the upwards air flow counterworks the downwards transmission of coal ignition, resulting in an unfavorable burning state, cause incomplete combustion and unable to burn the low grade coal; 2) the resident time of coal burning on the grate can not be long as the grate has a limited length, so the coal can not be fully burn up; and 3) the bottom layer of the coal is ignited at last, resulting in the fine coal particles to leak out from the vent slits of the grate and cause a big loss of coal.

SUMMARY OF THE INVENTION

An object of the present invention is to provide a boiler stoker for horizontal circulating combustible material, which overcome the following defects of the reciprocating and chain grates used for the existing coal-fired stokers: the resident time of coal burning on the grate is insufficient, the ignition of coal mainly by means of the heat radiation from the furnace, so the coal can not be fully burn up, unable to burn the low grade coal and the fine coal particles in the bottom layer is easy to leak out from the vent slits of the grate and lead to a remarkable coal loss.

In order to achieve the object of this invention, the technical scheme is as follows: let the both ends of the conventional stoker grate connect together and make an enclosed long annular moving grate. The coal is burn on the long annular grate with a pattern of horizontal circulating burning.

The first aspect of the invention provides a stoke of circulating burning-up, which comprises a stationary grate sheets support, moveable grate sheets supports fitting with prop rolls on the stationary grate sheets support, stationary grate sheets fitting with mounting transverse beams of the stationary grate sheets support, moveable grate sheets fitting with mounting transverse beams of the moveable grate sheets supports and a driving unit, wherein the moveable grate sheets and the stationary grate sheets are placed alternatively, the mentioned stationary grate sheets support has a long annular shape, the mentioned moveable sheet supports comprise a pair of rectangular supports opposed to each other and another pair of annular-shaped moveable grate sheet supports opposed to each other so as to form a long annular-shaped assembled support, the mentioned driving unit is a set of bearing units which are mounted on the stationary grate sheet support, oscillating rods are connected between the bearings of said bearing units, and at least one of the rectangular moveable grate sheet supports and the arc-shaped moveable furnace grate sheet supports in said moveable grate sheet supports, the arc-shaped or rectangular moveable grate sheet support connected with said oscillating rods is a driving moveable grate sheet support, the arc-shaped or rectangular moveable grate sheet support not connected with said oscillating rods is a driven moveable grate sheet support, the adjacent driving moveable grate sheet support is connected to the driven moveable grate sheet support with joint poles, and one of said oscillating rods is connected with a power input link.

The second aspect of the invention provides a stoke of circulating burning-up, which is long annular-shaped or annular-shaped. It comprises a stationary grate sheet support, moveable grate sheet supports fitting with prop rolls on the stationary grate sheet support, stationary grate sheets fitting with mounting transverse beams of the stationary grate sheet support, and moveable grate sheets fitting with mounting transverse beams of the moveable grate sheet supports, wherein the moveable grate sheets and the stationary grate sheets are placed alternatively, said stationary grate sheet support has a long annular or annular shape, said moveable grate sheet supports comprise a pair of rectangular moveable grate sheet supports opposed to each other and another pair of arc-shaped moveable grate sheet supports opposed to each other so as to form a long annular shape assembled support, said rectangular moveable grate sheet supports is connected to the arc-shaped moveable grate sheet supports with joint poles, and one of the said rectangular moveable grate sheet support or arc-shaped moveable grate sheet support is connected with a power input link.

The third aspect of the invention provides a stoke of circulating burning-up, which comprises a stationary grate sheet support, moveable grate sheet supports fitting with prop rolls on the stationary grate sheet support, stationary grate sheets fitting with mounting transverse beams of the stationary grate sheet support, moveable grate sheets fitting with mounting transverse beams of the moveable grate sheet supports, and a transmission unit, wherein the moveable grate sheets and the stationary grate sheets are placed alternatively, both the said stationary grate sheet support and moveable grate sheet supports have a long annular shape, the said transmission unit is a bearing unit which is located at the center of said moveable grate sheet supports and fixed to said stationary grate sheet support, an oscillating rod is connected between the bearing of said bearing unit and said moveable grate sheet supports, and said oscillating rod is connected with a power input link.

The fourth aspect of the invention provides a stoke of circulating burning-up, which comprises a grate support, a chain and a transmission unit, wherein the chain comprises a driving grate sheet chain and a driven grate sheets, the said driving grate sheet chain has a horizontal annular shape structure, the driven grate sheets are inserted in two opposed directions alternatively and fixed with the pin shafts of the driving grate sheet chain, the sides of the adjacent driven furnace grate sheets are overlapped or connected with each other, and there are one or more ash discharge exits on the side wall of the grate support.

The invention, as compared with the existing art, has the following features: the grate has a long annular shape structure, the coal can be circulated and burned on the grate, the resident time of coal burning on the grate can be much longer, the bottom burning coal layer forms a sufficient ignition heat source, the new feeding coal covers on the circulating burning coal layer, the combustion begins from the lower layer towards upper layer and keeps the same direction as that of the air flow, so as to form a good ignition condition and complete combustion state. The invention has the following benefit effects: 1) the coal can be totally burning up and combustion efficiency can be remarkably improved, (increased by more than 11% as compared to the conventional coal-firing stoker); 2) the blackness and the dust emission in the flue gas can be much lower; 3) combustion can be performed at low temperature (900° C.), desulphurization and the lower concentration of harmful NOx in the flue gas are achieved, and the effect can be correspond to that of the circulating fluidized-bed furnace; 4) the coal of low heating value (as low as 12.56 MJ/kg) can be burnt; and 5) the comprehensive operation cost is only a half of that of a circulating fluidized-bed furnace.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
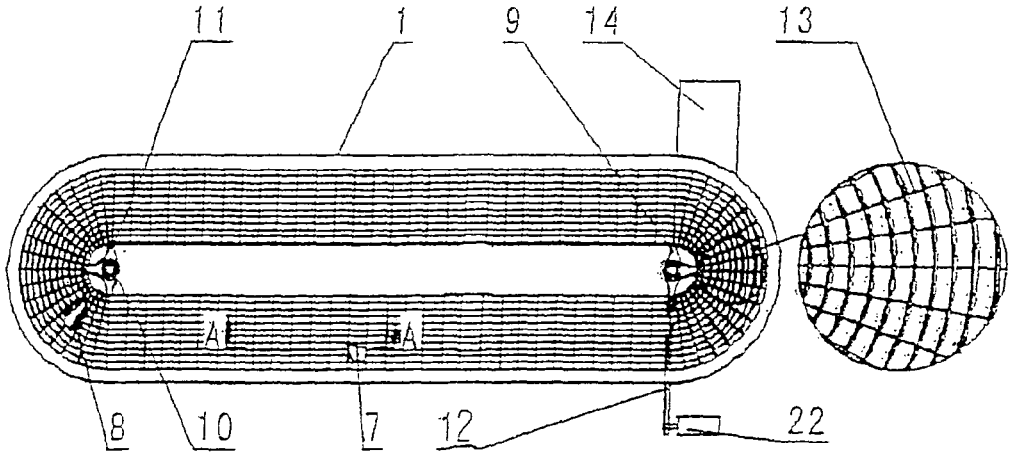
FIG. 1 is a schematic plan view of a stoker grate for circulating combustible material in the case that the said moveable grate sheet supports are long annular shape assembled supports and the said transmission unit is two sets of bearing units.
Figure 2:
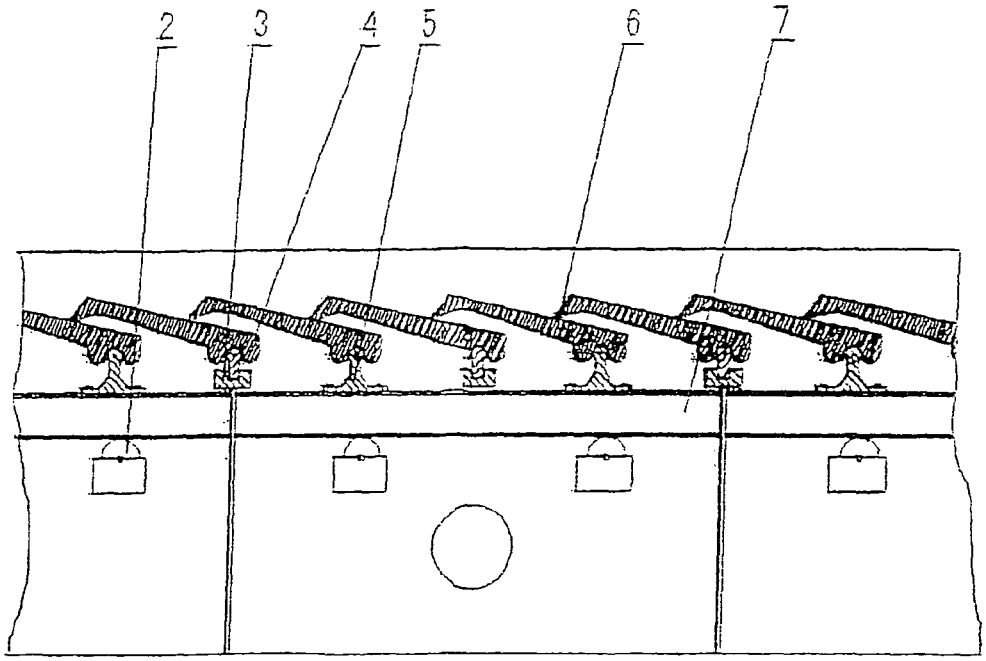
FIG. 2 is an enlarged structure schematic view of a stoker grate for circulating combustible material taken along A-A in FIG. 1. In the case that said moveable grate sheet supports are long annular shape assembled supports and said transmission unit is two sets of bearing units.

Hereinafter, the preferred embodiments of the invention will be described with reference to the drawings. In an embodiment shown as in FIGS. 1 and 2, the grate comprises a stationary grate sheet support 1, moveable grate sheet supports fitting with prop rolls 2 on the stationary grate sheet support 1, the stationary grate sheets 4 fitting with mounting transverse beams 3 of the stationary grate sheet support 1, moveable grate sheets 6 fitting with mounting transverse beams 5 of the moveable grate sheet support, and a transmission unit, wherein the moveable grate sheets 6 and the stationary grate sheets 4 are disposed alternatively, the stationary grate sheet support 1 has a long annular shape, the moveable grate sheet supports comprise a pair of rectangular moveable grate sheet supports 7 opposed to each other and another pair of semi-annular moveable grate sheet supports 8 opposed to each other to form a long annular shape assembled support, the transmission unit is two sets of bearing units 9 and 10, which are fixed to the stationary grate sheet support 1, and which are located at the centers of the semi-annular moveable grate sheet supports 8, respectively, oscillating rods 11 are connected respectively between the bearings of the bearing units 9 and 10, and respective semi-annular moveable grate sheet support 8, and between rectangular moveable grate sheet supports 7.

Figure 3:
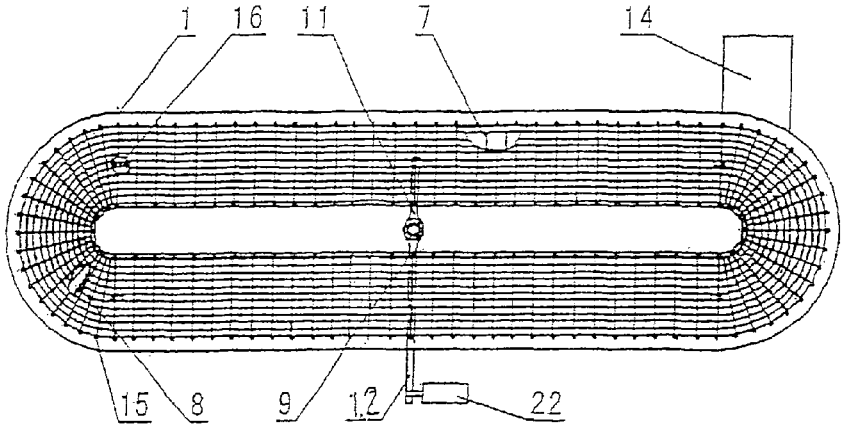
FIG. 3 is a structure schematic view of a stoker grate for circulating combustible material in the case that the said moveable grate sheet supports are long annular shape assembled supports and the said transmission unit is one set of bearing unit located at the center of the stationary grate sheet support.

One of the oscillating rods 11 is connected with a power input link 12. Between the stationary grate sheets 4 and the moveable grate sheets 6 in the combustion zone there are ash falling slits 13 of 15~20 mm, under which there is a ash discharge opening 14. In an embodiment shown as in FIG. 3, a transmission unit is a set of bearing unit 9 which is located at the center of said stationary grate sheet support 1, an oscillating rod 11 is connected between the bearing of the bearing unit 9 and the middle portion of the rectangular moveable grate sheet supports 7, roller seats each with a limit roller 15 are bolt-fixed onto the inner walls on two sides of the moveable grate sheets 6 on the semi-annular moveable grate sheet supports 8 corresponding stationary grate sheet support 1, and joint pole 16 are connected between the rectangular moveable grate sheet supports 7 and the semi-annular moveable grate sheet supports 8.

Figure 4:
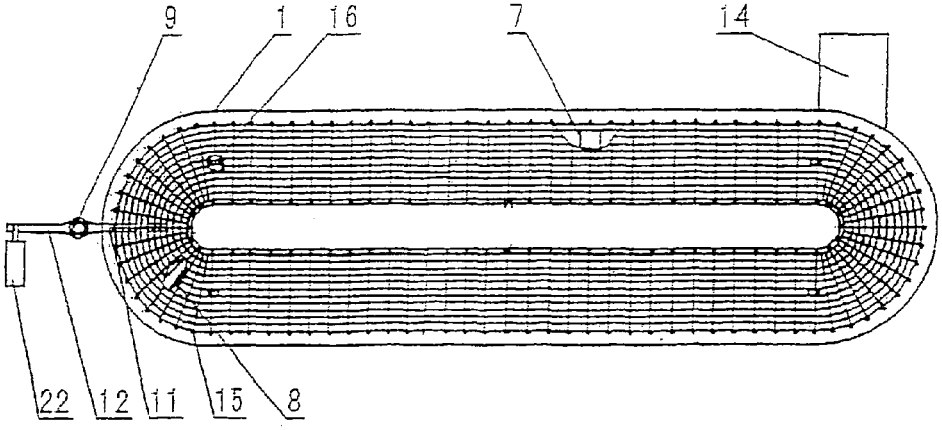
FIG. 4 is a structure schematic plan view of a stoker grate for circulating combustible material in the case that the said moveable grate sheet supports are long annular shape assembled supports and the said transmission unit is one set of bearing unit located on outside of the stationary grate sheet support.

In an embodiment shown as in FIG. 4, a transmission unit is a set of bearing unit 9 which is located the outside of the stationary grate sheet support 1, an oscillating rod 11 is connected between the bearing of the bearing unit 9 and one of the semi-annular moveable grate sheet supports 8 in the moveable grate sheet supports, and roller seats each with a limit roller 15 are bolt-fixed onto the inner walls on two sides of the moveable grate sheets 6 on the semi-annular moveable grate sheet supports 8 of stationary grate sheet support 1.

Figure 5:
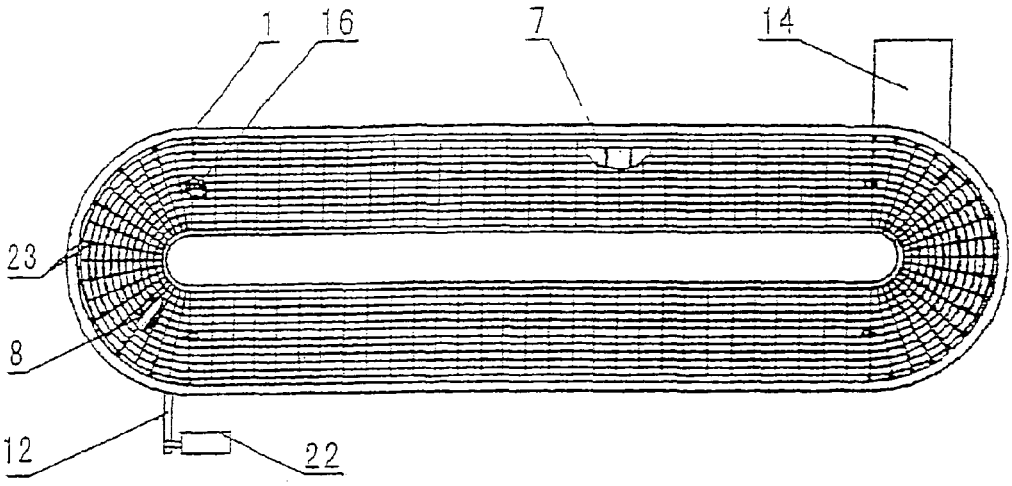
FIG. 5 is a structural top view of a stoker grate for circulating combustible material in the case that there is no said bearing unit.

In an embodiment without said bearing unit shown as in FIG. 5, one of said rectangular moveable grate sheet supports 7 or semi-annular shape moveable grate sheet supports 8 is connected with a power input link 12, and limit rollers 23 are fixed onto the inner walls on outside plate at the semi-annular moveable grate sheet supports 8 of stationary grate sheet support 1.

Figure 6:
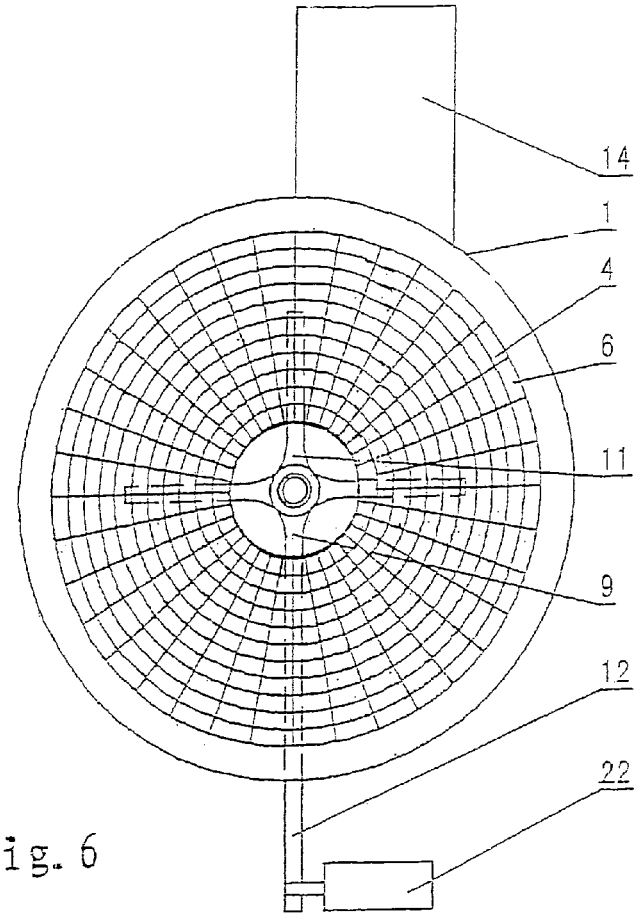
FIG. 6 is a structure schematic view of a stoker grate for circulating combustible material in the case that both stationary grate sheet support and moveable grate sheet supports have a annular shape.

In an embodiment shown as in FIG. 6, a grate comprises a stationary grate sheet support 1, a moveable grate sheet support fitting with prop rolls 2 on the stationary grate sheet support 1, stationary grate sheets 4 fitting with mounting transverse beams of the stationary grate sheet support 1, moveable grate sheets 6 fitting with mounting transverse beams of the moveable grate sheet support, and a transmission unit, wherein the moveable grate sheets 6 and the stationary grate sheets 4 are disposed alternatively, both the stationary grate sheet support 1 and the moveable grate sheet support are annular in shape, the transmission unit is a bearing unit 9 which is fixed to the stationary grate sheet support 1, and which are located at the center of the annular of the moveable grate sheet support, respectively, oscillating rods 11 are connected between the bearing of the bearing unit 9 and the moveable grate sheet support, one of the oscillating rods 11 is connected with a power input link 12. Between the stationary grate sheets 4 and between the moveable grate sheets 6 there are ash falling slits 13 of 15~20 mm above a ash discharge opening 14 correspondingly.

Figure 7:
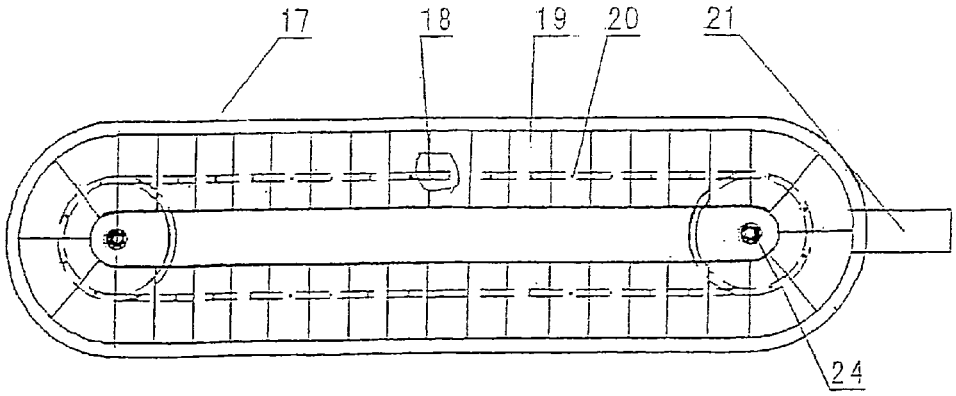
FIG. 7 is a schematic view of a stoker grate for circulating combustible material in the case that it is consisted of a chain structure.

In an embodiment shown as in FIG. 7, a grate comprises a grate support 17, a chain and a transmission unit, wherein the chain comprises a driving grate sheet chain 18 and a driven grate sheets 19, the driving grate sheet chain 18 has a horizontal long annular shape structure, the driven grate sheets 19 are inserted in two opposed directions alternately and fixed with the pin shafts 20 of the driving grate sheet chain 18, the adjacent driven grate sheets 19 are overlapped or connected with each other, and on a side wall of the grate sheet support 17 there is a ash discharge exit 21. When the embodiments shown in FIGS. 1-6 are been carried out, the link 12 is connected with a driver 22. When the embodiment shown in FIG. 7 is been carried out, a driving chain pulley shaft 24 is connected with a power input device.

The slag/ash particles with biggish size are discharged through the ash discharge opening 14 by a comb-shaped screw conveyer. The slag/ash particles with lesser size are discharged through the ash falling slits 13. On the walls around the stoker some observation doors are arranged. Before the stoker is starting up some incendive material is put on the hearth and then ignited by a gas or oil ignition gun. When the incendive material was burnt fully over the hearth the stoker can be started-up, the coal will feeding down through the coal hoppers on the hearth to form a circulating combustion.

The above-mentioned stoker has a singer line structure. For the boilers of large capacity the width of the hearth should be increased, and let the fuel distribution on the arc-shaped moveable grate along the radial direction become uneven, The inboard fuel layer will be thick, the outboard fuel layer will be thin and the combustion effect will be worsened. To solve this problem the two, three or multiply lines structure of the stoker can be taken.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A stoker grate for circulating a combustible material, the stoker grate having an annular shape, comprising a stationary grate sheet support having an annular shape, a moveable grate sheet support fitting with prop rolls on the stationary grate sheet support, the moveable grate sheet support comprising a pair of rectangular moveable grate sheet supports opposed to each other and another pair of arc-shaped moveable grate sheet supports opposed to each other to form an annular-shaped assembled support, the rectangular moveable grate sheet supports being hinged with the annular-shape moveable grate sheet supports, one of the rectangular moveable grate sheet supports or the arc-shaped moveable grate sheet supports being connected with a power input link, stationary grate sheets fitting with mounting transverse beams of the stationary grate sheet support, moveable grate sheets fitting with mounting transverse beams of the moveable grate sheet supports, the moveable grate sheets and the stationary grate sheets being disposed alternatingly, the stoker grate being structured so that movement of the power input link and resulting movement of the moveable grate sheets causes the combustible material to move by circulating in an enclosed annular path of movement so as to be capable of traveling completely around a perimeter of the annular-shaped stoker grate.

2. The stoker grate according to claim 1, characterized by that: limit rollers are fixed onto inner walls of the stationary grate sheet support at locations corresponding to the arc-shaped moveable grate sheet supports.

3. The stoker grate according to claim 1, characterized by that: said arc-shaped moveable grate sheet supports have a semicircular shape.

4. The stoker grate according to claim 1, characterized by that: between said stationary grate sheets and between said moveable grate sheets in a combustion zone there are ash falling slits of 15-20 mm.

5. A stoker grate for circulating a combustible material in an enclosed annular path of movement, the stoker grate having an annular shape, comprising:

a stationary grate sheet support having a long annular shape, a moveable grate sheet support fitting with prop rolls on the stationary grate sheet support, the moveable grate sheet support comprising a pair of rectangular moveable grate sheet supports opposed to each other and another pair of arc-shaped moveable grate sheet supports opposed to each other to form a long annular-shaped assembled support, stationary grate sheets fitting with mounting transverse beams of the stationary grate sheet support, moveable grate sheets fitting with mounting transverse beams of the moveable grate sheet support, the moveable grate sheets and the stationary grate sheets being disposed alternatingly, and a transmission unit comprising at least one bearing unit which is fixed to the stationary grate sheet support, an oscillating rod is connected between the bearing of the bearing unit and the rectangular or arc-shaped moveable grate sheet support, the rectangular or arc-shaped moveable grate sheet support connected with the oscillating rod is a driving moveable grate sheet support, the rectangular or arc-shaped moveable grate sheet support not connected with the oscillating rod is a driven moveable grate sheet support, the driving moveable grate sheet support is hinged to the adjacent driven moveable grate sheet support and the driven moveable grate sheet supports are hinged to each other, and the oscillating rod is connected with a power input link, the stoker grate being structured so that oscillation of the oscillating rod and resulting oscillation of the moveable grate sheets causes the combustible material to move by circulating in an enclosed annular path of movement so as to be capable of traveling completely around a perimeter of the annular-shaped stoker grate.

6. The stoker grate according to claim 5, characterized by that: said transmission unit comprises two of the bearing units which are located at the centers of the arc-shaped moveable grate sheet supports, respectively, and the oscillating rods are connected between the bearings of the bearing units and the respective arc-shaped moveable grate sheet supports.

7. The stoker grate according to claim 5, characterized by that: said transmission unit comprises one of the bearing units which is located at the center of the stationary grate sheet support, oscillating rods are connected between the bearing of the bearing unit and middle portions of the rectangular moveable grate sheet supports, and roller seats with a limit roller are fixed onto inner walls of the stationary grate sheet support at locations corresponding to the arc-shaped moveable grate sheet supports.

8. The stoker grate according to claim 5, characterized by that: said transmission unit comprises one of the bearing units which is located on the outside of the stationary grate sheet support, an oscillating rod is connected between the bearing of the bearing unit and one of the rectangular or arc-shaped moveable grate sheet supports, and roller seats with a limit roller are fixed onto inner walls of the stationary grate sheet support at locations corresponding to the arc-shaped moveable grate sheet supports.

9. The stoker grate according to claim 5, characterized by that: said arc-shaped moveable grate sheet supports have a semicircular shape.

10. The stoker grate according to claim 6, characterized by that: said arc-shaped moveable grate sheet supports have a semicircular shape.

11. The stoker grate according to claim 7, characterized by that: said arc-shaped moveable grate sheet supports have a semicircular shape.

12. The stoker grate according to claim 8, characterized by that: said arc-shaped moveable grate sheet supports have a semicircular shape.

13. The stoker grate according to claim 5, characterized by that: between said stationary grate sheets and between said moveable grate sheets in a combustion zone there are ash falling slits of 15-20 mm.

14. The stoker grate according to claim 6, characterized by that: between said stationary grate sheets and between said moveable grate sheets in a combustion zone there are ash falling slits of 15-20 mm.

15. The stoker grate according to claim 7, characterized by that: between said stationary grate sheets and between said moveable grate sheets in a combustion zone there are ash falling slits of 15-20 mm.

* * * * *